US012459078B2

(12) United States Patent
Wu et al.

(10) Patent No.: US 12,459,078 B2
(45) Date of Patent: Nov. 4, 2025

(54) IN-SITU CONDITIONER DISK CLEANING DURING CMP

(71) Applicant: Applied Materials, Inc., Santa Clara, CA (US)

(72) Inventors: Haosheng Wu, San Jose, CA (US); Shou-Sung Chang, Mountain View, CA (US); Jianshe Tang, San Jose, CA (US); Jeonghoon Oh, Saratoga, CA (US); Chad Pollard, San Jose, CA (US); Chih Chung Chou, San Jose, CA (US); Ningzhuo Cui, Santa Clara, CA (US); Hui Chen, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 370 days.

(21) Appl. No.: 17/967,762

(22) Filed: Oct. 17, 2022

(65) Prior Publication Data

US 2023/0390895 A1 Dec. 7, 2023

Related U.S. Application Data

(60) Provisional application No. 63/349,560, filed on Jun. 6, 2022.

(51) Int. Cl.
*B24B 53/017* (2012.01)
*B24B 37/04* (2012.01)
(Continued)

(52) U.S. Cl.
CPC ..... *B24B 53/017* (2013.01); *B24B 37/042* (2013.01); *B24B 53/005* (2013.01); *B24B 53/007* (2013.01); *B24B 53/12* (2013.01)

(58) Field of Classification Search
CPC ... B24B 53/017; B24B 53/005; B24B 53/007; B24B 53/04; B24B 53/042; B24B 37/042
See application file for complete search history.

(56) References Cited

U.S. PATENT DOCUMENTS 5,738,574 A 4/1998 Tolles et al.
2002/0048957 A1 * 4/2002 Yang ..... B24B 53/017 438/692
(Continued)

FOREIGN PATENT DOCUMENTS

CN 111842259 10/2020
EP 1055486 11/2000
(Continued)

OTHER PUBLICATIONS

International Search Report and Written Opinion in International Appln. No. PCT/US2022/078237, mailed on Mar. 2, 2023, 11 pages.
(Continued)

*Primary Examiner* — C. A. Rivera
(74) *Attorney, Agent, or Firm* — Fish & Richardson P.C.

(57) ABSTRACT

A polishing system includes a platen to hold a polishing pad, a carrier head to hold a substrate against the polishing pad, a conditioner including a conditioner head to hold a conditioner disk against the polishing pad, a motor to move the conditioner head laterally movable relative to the platen, a conditioning disk cleaning station positioned adjacent the platen to clean the conditioning disk, and a controller configured to cause the motor to, during polishing of the substrate, move the conditioner head back and forth between a first position with the conditioner head over the polishing pad and a second position with the conditioner head in the conditioner disk cleaning station.

20 Claims, 4 Drawing Sheets

(51) Int. Cl.

| | |
|---|---|
| ***B24B 53/00*** | (2006.01) |
| ***B24B 53/007*** | (2006.01) |
| ***B24B 53/12*** | (2006.01) |

(56) References Cited

U.S. PATENT DOCUMENTS

| | | | | |
|---|---|---|---|---|
| 2002/0072312 | A1* | 6/2002 | Park | B24B 53/017 451/56 |
| 2006/0035568 | A1 | 2/2006 | Dunn | |
| 2007/0254558 | A1 | 11/2007 | Kodera et al. | |
| 2008/0311834 | A1* | 12/2008 | Lafon | B24B 1/04 451/444 |
| 2010/0273401 | A1* | 10/2010 | Shiratani | B24B 53/017 451/64 |
| 2014/0041687 | A1 | 2/2014 | Shinozaki | |
| 2015/0314417 | A1 | 11/2015 | Sun et al. | |

FOREIGN PATENT DOCUMENTS

| | | | |
|---|---|---|---|
| JP | 2004-273530 | | 9/2004 |
| JP | 2004273530 | A * | 9/2004 |
| JP | 2010-253637 | | 11/2010 |
| KR | 10-2017-0038434 | | 4/2017 |
| TW | 200409693 | | 6/2004 |
| TW | 200613092 | | 5/2006 |
| TW | M528231 | | 9/2016 |
| TW | 202207299 | | 2/2022 |

OTHER PUBLICATIONS

Office Action in Taiwanese Appln. No. 111139629, dated Jul. 3, 2023, 14 pages (with English summary and search report).

* cited by examiner

IN-SITU CONDITIONER DISK CLEANING DURING CMP

CROSS-REFERENCE TO RELATED APPLICATIONS

This application claims the benefit of priority to U.S. Application No. 63/349,560, filed on Jun. 6, 2022, the contents of which are hereby incorporated by reference.

TECHNICAL FIELD

The present disclosure relates to chemical mechanical polishing (CMP), and more specifically to polishing pad conditioners.

BACKGROUND

An integrated circuit is typically formed on a substrate by the sequential deposition of conductive, semiconductive, or insulative layers on a silicon wafer. One fabrication step involves depositing a filler layer over a non-planar surface of an underlying layer and planarizing the filler layer. For some applications, such as metal polishing, a filler layer is planarized until the top surface of the underlying patterned layer is exposed. For other applications, such as oxide polishing, the filler layer is planarized until a predetermined thickness is left over the non-planar surface. In addition, planarization of the substrate surface is usually required for photolithography.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing liquid, typically including an abrasive and at least one chemically reactive agent, may be spread on the polishing pad.

When the polisher is in operation, the pad is subject to compression, shear and friction producing heat and wear. Slurry and abraded material from the wafer and pad are pressed into the pores of the pad material and the material itself becomes matted and even partially fused. These effects, sometimes referred to as "glazing," reduce the pad's roughness and ability to apply fresh slurry to the substrate. It is, therefore, desirable to condition the pad by removing trapped slurry, and unmatting, re-expanding or re-roughening the pad material.

The polishing system typically includes a conditioner system to condition the polishing pad. Conditioning of the polishing pad maintains the polishing surface in a consistent roughness to ensure uniform polishing conditions from wafer-to-wafer. A conventional conditioner system has a conditioner head which holds a conditioner disk with an abrasive lower surface, e.g., with diamond particles, that is placed into contact with the polishing pad. Contact and motion of the abrasive surface against the polishing pad roughens the polishing surface. The pad can be conditioned after each substrate is polished, or after a number of substrates are polished. The pad can also be conditioned at the same time substrate are polished.

Slurry and polishing debris can stick to the conditioning disk. Therefore a polishing system can also include a conditioner disk washing station. The conditioning operation is performed, e.g., by sweeping the conditioner disk back and forth multiple times across the polishing pad. After the pad has been conditioned for the desired time, the conditioner disk is lifted off the polishing pad and moved to a separate cleaning station for cleaning. The conditioning disk can be returned to the polishing pad for a new substrate.

SUMMARY

In one aspect, a polishing system includes a platen to hold a polishing pad, a carrier head to hold a substrate against the polishing pad, a conditioner including a conditioner head to hold a conditioner disk against the polishing pad, a motor to move the conditioner head laterally movable relative to the platen, a conditioning disk cleaning station positioned adjacent the platen to clean the conditioning disk, and a controller configured to cause the motor to, during polishing of the substrate, move the conditioner head back and forth between a first position with the conditioner head over the polishing pad and a second position with the conditioner head in the conditioner disk cleaning station.

In another aspect, a method of chemical mechanical polishing includes bringing a substrate into contact with a polishing pad, and during polishing of the substrate sweeping a conditioning disk between a first position in contact with the polishing pad and a second position in a conditioning disk cleaning station.

One or more of the following possible advantages may be realized. Corrosion of the conditioner disk, e.g., during polishing of tungsten layers, can be reduced. Thus a risk of defects or scratching of the substrate can be reduced. Slurry build-up on the bottom surface of the conditioning disk can be avoided, thus reducing the risk of coagulation and defects. The conditioner disk can also have a longer life.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

As noted above, a chemical mechanical polishing process can include a pad conditioning step in which a conditioner disk, e.g., a disk coated with abrasive diamond particles, is pressed against the rotating polishing pad to condition and texture the polishing pad surface. In an "in-situ" conditioning process the conditioner disk contacts the polishing pad while the substrate is being polished. This permits conditioning to be performed at the same time as polishing, and thus is more time efficient and has higher substrate throughput. However, the conditioning disk is exposed to the polishing slurry. In an "ex-situ" conditioning process the conditioner disk contacts the polishing pad after the substrate has been polished, typically after the pad has been washed to remove slurry. This reduces exposure of the conditioning disk to slurry, but has lower throughput.

When the conditioner disk is not being used for condition, it can be positioned in a cleaning station. For conventional "in-situ" and "ex-situ" conditioning this occurs once per substrate. For "ex-situ" conditioning the disk is placed in the cleaning station while the substrate is being polished, and returned to the polishing pad after each polishing operation. For "in-situ" conditioning the disk is placed in the cleaning station after the polishing operation, and returned to the polishing pad when a new substrate has been loaded and is ready for polishing.

Some polishing processes, e.g., polishing of tungsten (W), pose the danger of corrosion of the stainless steel backing layer of the conditioning disk. As a result, in-situ conditioning can result in a significantly lower conditioner disk lifetime, as the disk must be replaced before the corrosion poses a danger of contamination of the polishing process. On the other hand, the ex-situ conditioning has lower throughput.

A technique that can mitigate these issues is to place the cleaning station in a position where the conditioning disk can be periodically cleaned during the polishing operation. In particular, a conditioning disk cleaning station can be located at the edge of the platen in a position where it can be reached by the sweep of the disk by the conditioner arm. This permits the conditioning disk to be cleaned, e.g., with each sweep of the arm.

Figure 1:
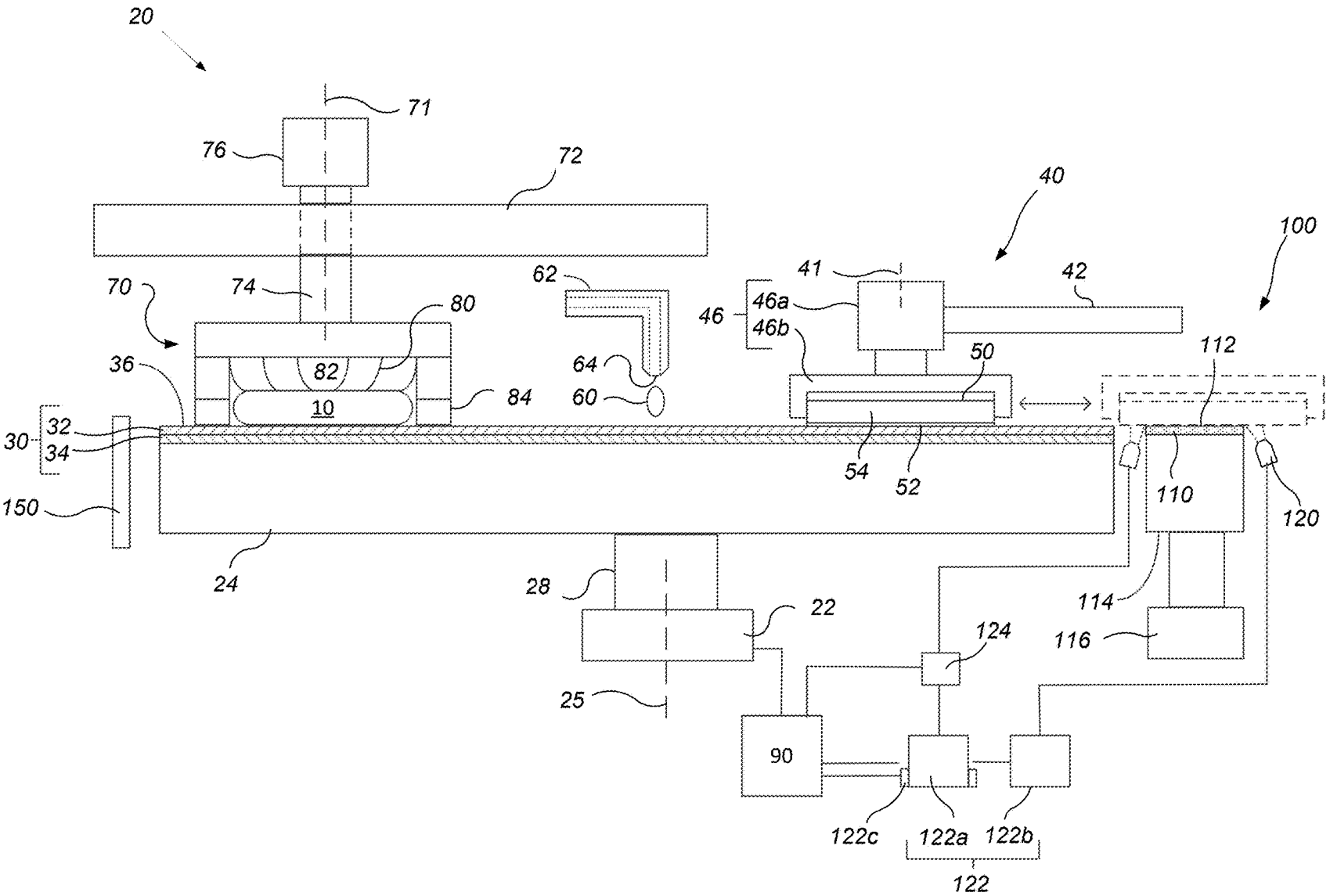
FIG. 1 is a schematic cross-sectional side view of a polishing system that includes a conditioner disk cleaning system.
Figure 2:
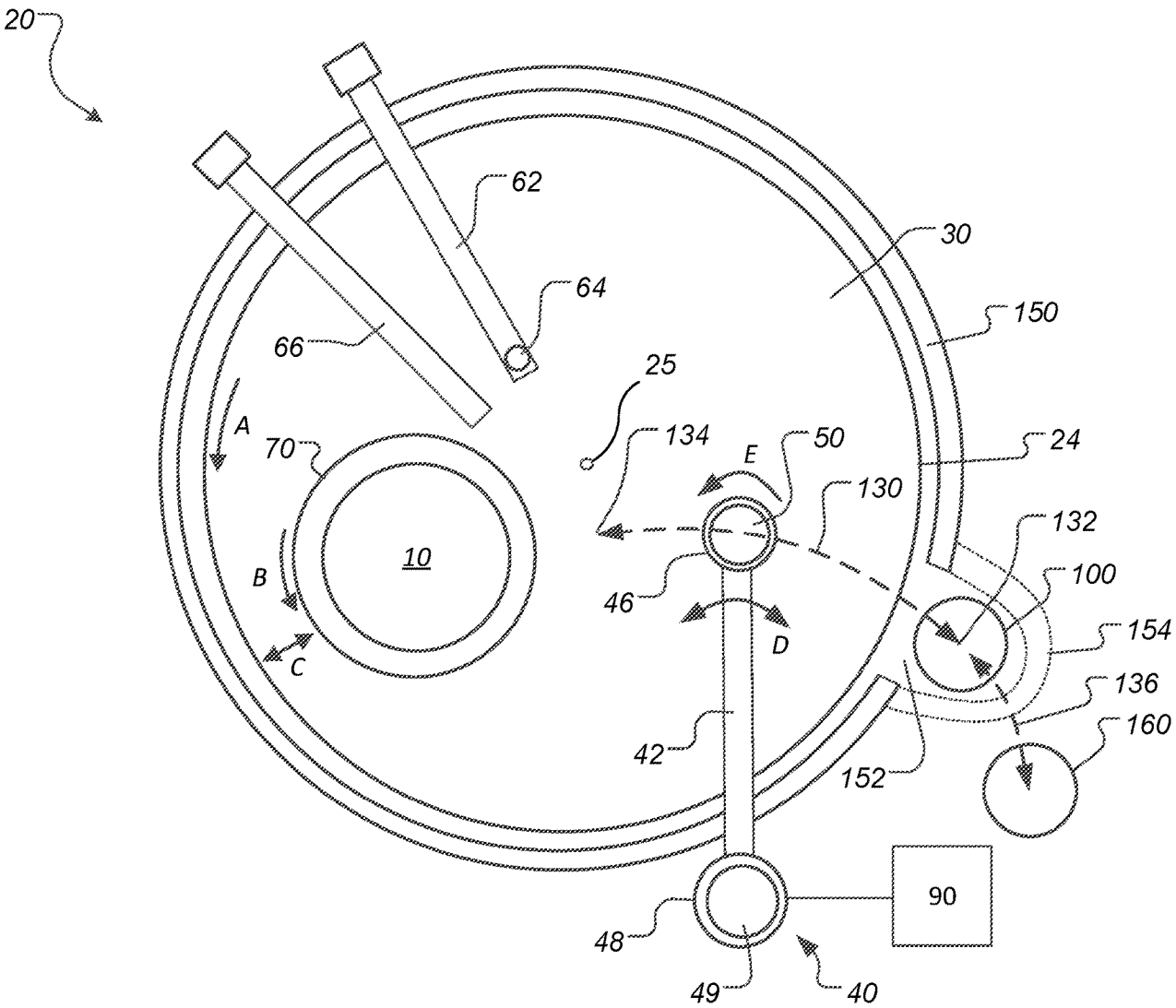
FIG. 2 is a schematic top view of a polishing system.
Figure 3:
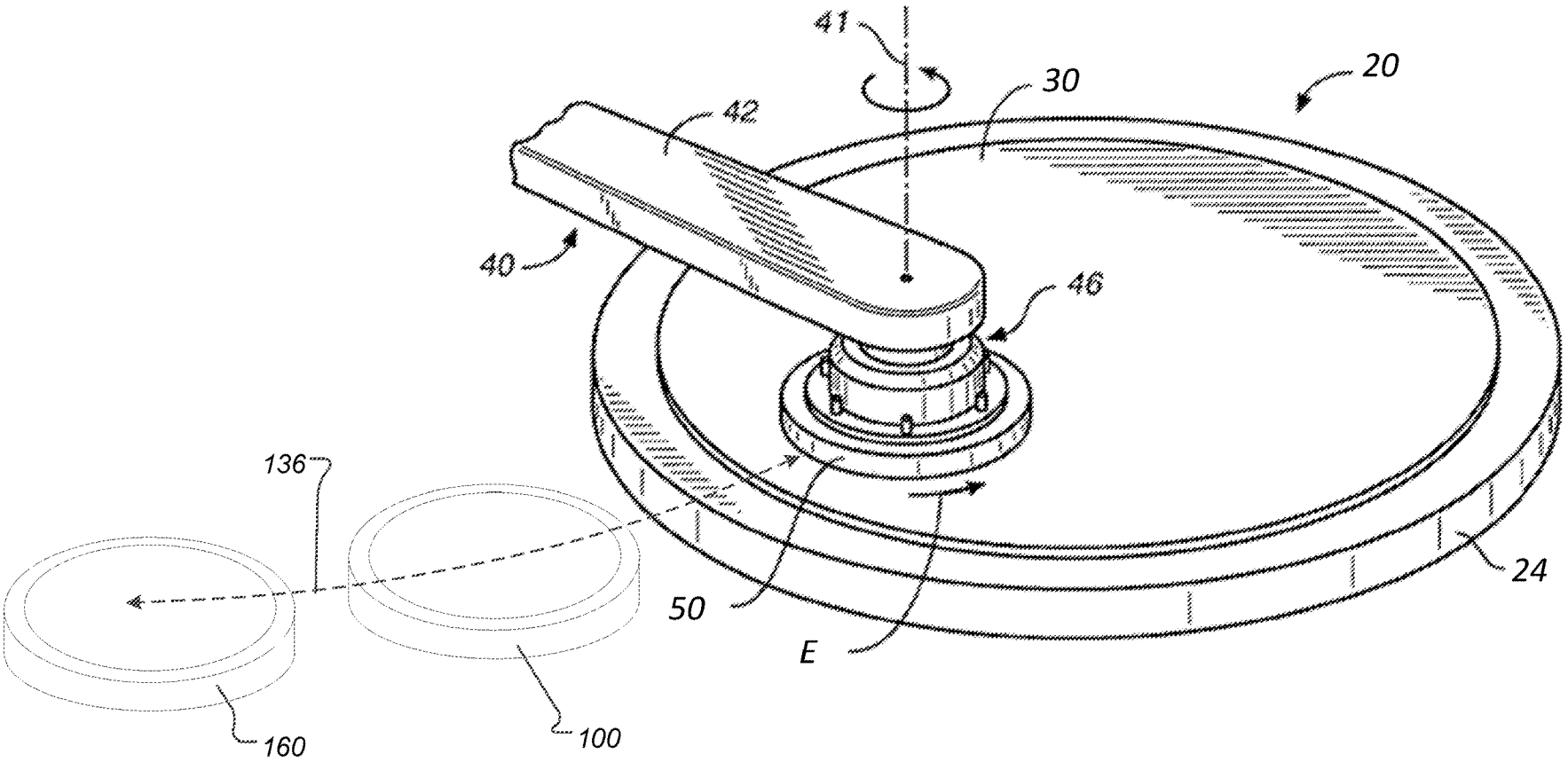
FIG. 3 is a schematic perspective view of a conditioner head placed on a polishing pad.

As shown in FIGS. 1-3, a chemical mechanical polishing system 20 includes a rotatable platen 24 on which a polishing pad 30 is situated. The platen 24 is operable to rotate (see arrow A in FIG. 2) about an axis 25. For example, a motor 22 can turn a drive shaft 28 to rotate the platen 24. The polishing pad 30 can be a two-layer polishing pad with an outer polishing layer 32 having a polishing surface 36 and a softer backing layer 34.

The polishing system 20 includes a supply port 64, e.g., at the end of a slurry supply arm 62, to dispense a polishing liquid 60, such as an abrasive slurry, onto the polishing pad 30. In some implementations, the polishing system 20 includes a wiper blade or body 66 (see FIG. 2) to evenly distribute the polishing liquid 60 across the polishing pad 30.

The carrier head 70 is suspended from a support structure 72, e.g., a carousel or a track, and is connected by a drive shaft 74 to a carrier head rotation motor 76 so that the carrier head can rotate about an axis 71 (see arrow B in FIG. 2). Optionally, the carrier head can oscillate laterally (see arrow C in FIG. 2), e.g., on sliders on the carousel or track 72; or by rotational oscillation of the carousel itself. In operation, the platen is rotated about its central axis 25, and the carrier head is rotated about its central axis 71 and translated laterally across the top surface of the polishing pad 30. The carrier head 70 can include a flexible membrane 80 having a substrate mounting surface to contact the back side of the substrate and a plurality of pressurizable chambers 82 to apply different pressures to different zones, e.g., different radial zones, on the substrate 10. The carrier head can also include a retaining ring to hold the substrate. The carrier head 70 can include a retaining ring 84 to hold the substrate below the membrane 80.

The polishing station 20 also includes a pad conditioner 40 with a conditioner disk 50 to maintain the surface roughness of the polishing pad 30. A bottom surface of the conditioner disk 50 includes one or more abrasive regions 52 that contact the polishing surface 36 during the conditioning process. The abrasive regions can be provided by abrasive diamond particles that are secured to a lower surface of a backing plate 54. The backing plate 54 is typically a metal, such as stainless steel, although other materials such as a ceramic are possible. In some implementations, abrasive particles of other compositions, e.g., silicon carbide, are be used instead of or in addition to diamond particles.

During conditioning, the abrasive regions move relative to the surface of the polishing pad 30, thereby abrading and retexturizing the polishing surface 36. For example, both the polishing pad 30 and the conditioning disk 50 can rotate (see arrows A and E in FIG. 2).

The conditioner disk 50 can be held by a conditioner head 46 at the end of an arm 42. The arm 42 and conditioner head 46 are supported by a base 48. The arm 42 can swing so as to sweep the conditioner head 46 and conditioner disk 50 laterally across the polishing pad 30. For example, the base 48 can be driven by a motor 49 to pivot about a vertical axis and thereby sweep the arm 42 and the conditioner head 46 laterally over the platen 24 and polishing pad 30.

The conditioner head 46 includes mechanisms to attach the conditioner disk 50 to the conditioner head 46 (such as mechanical attachment systems, e.g., bolts or screws, or magnetic attachment systems) and mechanisms to rotate the conditioner disk 50 around an axis 41 (such as drive belts through the arm or rotors inside the conditioner head). In addition, the pad conditioner 40 can also include mechanisms to regulate the pressure between the conditioner disk 50 and the polishing pad 30 (such as pneumatic or mechanical actuators inside the conditioning head or the base) and/or to change the vertical position of the conditioner disk 50 relative to the polishing pad 30. For example, the conditioner head 46 can include an upper portion **46*a*, a lower portion 46*b* that holds the condition disk 50, and an actuator to adjust the vertical position of the lower portion 46*b* relative to the upper portion 46*a* or to adjust the pressure of the conditioner disk 50 on the polishing pad 30. However, these mechanisms can have many possible implementations (and are not limited to those shown in FIG. 1). As other examples, a vertical actuator can be located in the base 48 to lift and lower the arm 42, or the arm can be pivotally attached to the base 48 in a manner that permits it to swing vertically to lower and lift the conditioner head 46 from the polishing pad 30**.

The polishing station 20 also includes a conditioner cleaning station 100 positioned adjacent the platen 24. The conditioner cleaning station 100 can include a brush 110 with a brush surface 112 to contact the bottom surface of the conditioner disk 50. The brush surface 112 can be sponge-like, e.g., a porous surface, or can have bristles. The brush surface, whether sponge-like or bristled, can be provided by a polymer material that does not interact with the chemistry used in the CMP process, e.g., nylon, a polyvinyl chloride (PVC), a polyvinyl acetal (PVA), polypropylene, or polyurethane.

As shown in FIG. 1, the brush 110 can be a disk-shaped brush with a generally planar circular surface 112. The brush 110 can be supported on a support 114 that can be rotated by a motor 116 about a vertical axis, e.g., an axis perpendicular to the surface of the conditioner disk 50.

Figure 4:
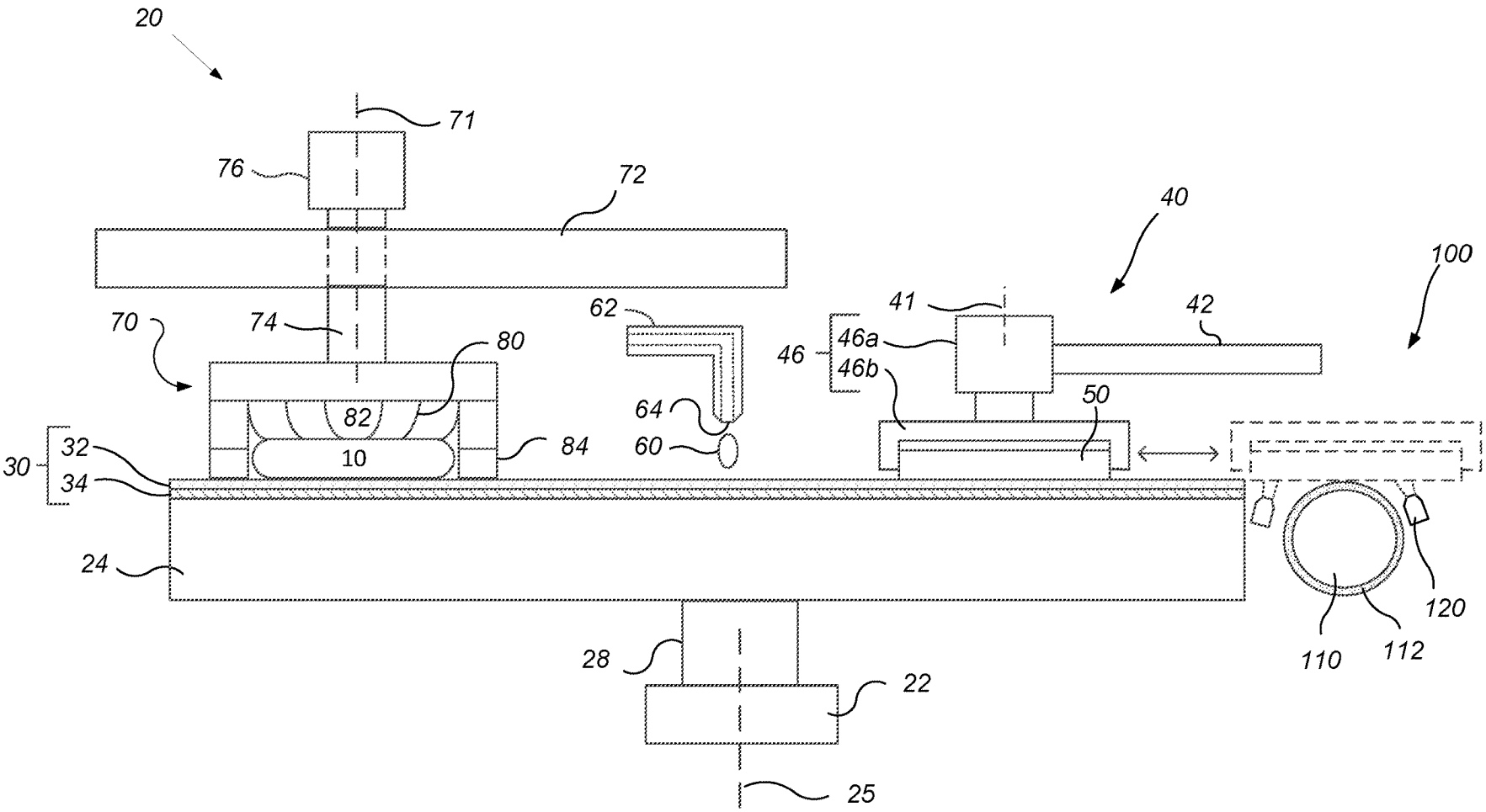
FIG. 4 is a schematic cross-sectional side view of a polishing system that includes another implementation of a conditioner disk cleaning system.

Alternatively, as shown in FIG. 4, the brush 110 can be a cylindrical-shaped brush with a cyclindrical surface 112. The brush 110 can be supported on a support that can be rotated by a motor about a horizontal axis, e.g., an axis parallel to the surface of the conditoner disk 50. The axis of rotation can be substantially perpendicular to the direction of motion of the conditioner head 46 as the arm 42 sweeps the conditioner head 46 across the brush 110.

The conditioner cleaning station 100 can also include one or more nozzles 120 to spray one or more fluids from a source 122 onto the bottom surface of the conditioner disk 50 as it is positioned in the cleaning station 100, e.g., when the conditioner disk 50 is over the brush 110. The fluid can be a liquid, such as one or more of deionized water (DI water), or water with cleaning chemistry, e.g., a pH adjuster. The fluid can be a gas, e.g., air, nitrogen gas, or steam.

In some implementations, the fluid source 122 includes a reservoir 122*a* of cleaning liquid, e.g., DI water, and a pump 124 can be used to direct the cleaning fluid through one or more nozzles onto the conditioner disk 50. This can wash the polishing liquid from conditioner disk and conditioner head to reduce the likelihood of corrosion.

In some implementations, the fluid source 122 includes a compressor 122*b* to direct a jet of gas, e.g., air, through one or more nozzles onto the conditioner disk 50. This can dry the conditioner disk and conditioner head.

In some implementations, the conditioner disk cleaning system 100 uses multiple fluids and there are one or more dedicated nozzles for each fluid, i.e., each nozzle receives only a certain fluid. In some implementations, valves and piping can be used so that the fluid directed through a nozzle is selectable from multiple fluids.

The temperature of the fluid(s) can be controlled using a heater and/or chiller 122*c*. The temperature can be in the range of 0-100° C. The heater and/or chiller can be provided by a heat exchanger thermally coupled to the reservoir 122*a* to control the temperature of the fluid in the reservoir, or to a fluid line that carries fluid from the source, e.g., the reservoir, to the nozzles 120.

For either the disk-shaped brush or the cylindrical-shaped brush, a top surface 112 of the brush 110 that will contact the conditioning disk 50 can be coplanar with the polishing surface 36 of the polishing pad 30. This permits the arm 42 to sweep the conditioner disk 50 into conditioner cleaning station 100 and into contact with the brush 110 without having to change the vertical position of the conditioner disk 50, e.g., without having to retract the conditioner disk 50. However, in some implementations that top surface 112 of the brush 110 is above or below the polishing surface 36; in this case the conditioner disk can be raised or lowered as it passes from the polishing pad 30 to the cleaning station 100.

In some implementations the polishing system 20 includes a platen shield 150, i.e., a wall that surrounds the platen 24 to prevent slurry that is expelled by centrifugal motion of the platen 24 from splashing on other nearby components. The arm 42 can project over the wall 150, with the conditioner head 46 extending below the top of the wall to hold the conditioner disk against the polishing pad 30. However, the platen shield 150 can be provided with an aperture 152 through which the conditioner head 46 can move laterally to reach the conditioning disk cleaning station 100. Again, this permits the arm 42 to sweep the conditioner disk 50 into conditioner cleaning station 100 and into contact with the brush 110 without having to change the vertical position of the conditioner disk 50, e.g., without having to retract the conditioner disk 50. In some implementations, a portion 154 of the wall extends to surround the conditioning disk cleaning station 100.

Motion of the conditioner head 46, e.g., the lateral sweep (shown by arrow D in FIG. 2) and vertical actuation of the conditioner disk 50 and/or conditioner head 46 is controlled by a controller 90. For example, the controller 90 can be coupled to the motor 49 to control the lateral position of the arm 42 and conditioner head 46. The controller 90 can also be coupled to appropriate components, e.g., pump 124 or compressor 122*b*, to control flow of fluids from the nozzles, and to the motor 116 to control rotation of the brush 110.

In operation, while the substrate 10 is being polished on the polishing pad 30, the controller 90 can cause the conditioner head 46 and conditioner disk 50 to sweep laterally back and forth along a path 130 that covers both the polishing pad 30 and the pad conditioner cleaning station 100. One endpoint 132 of the path 130 can lie over the pad conditioner cleaning station 100. The other endpoint 134 of the path is over the polishing pad, e.g., at a point as close to the center and axis of rotation 25 of the platen 24 as the conditioner head 46 can reach on the arm. Thus, with each sweep of the conditioner head 46, the conditioner disk enters the pad conditioner cleaning station 100 and can be cleaned to remove polishing fluid and debris. This can prevent corrosion of the conditioner disk 50 with only limited or no impact on throughput of substrates.

In some implementations, the sweep pattern is set so that the conditioner head 50 remains stationary at the endpoint 132, e.g., in the conditioner disk cleaning station 100, for a period of time (referred to as the dwell time). The dwell time for the conditioner head 50 in the conditioner disk cleaning station 100 can be set by the user, e.g., at one to ten seconds. In some implementations, the sweep pattern is set so that the conditioner head 50 travels more slowly while moving through the conditioner disk cleaning station 100 than when moving over the polishing pad.

In some implementations, the sweep pattern is set so that when the carrier head reaches the endpoint 132, the conditioner disk 50 is entirely removed from the polishing pad 30. However, the sweep pattern can also be set so that when the carrier head reaches the endpoint 132, a portion of the conditioner disk 50 is over the polishing pad 30 and a portion of the conditioner disk 50 is over the brush 110.

In some implementations, the sweep pattern is set so that the conditioner head 50 does not enters the pad conditioner cleaning station 100 with each sweep, but still enters the pad conditioner cleaning station 100 periodically, e.g., every two to ten sweeps. In this case, the controller 90 would cause the conditioner head 46 and conditioner disk 50 to make one or more sweeps in which both endpoints are over the polishing pad 30, followed by a sweep with an endpoint over the pad conditioner cleaning station 100.

In some implementation, the polishing system 20 includes a second conditioner cleaning station 160. This second conditioner cleaning station 160 can be positioned further along the sweep path of the conditioner head 46 from the platen 24 than conditioner cleaning station 100. The second conditioner cleaning station 160 can include a cleaning cup, which contains a cleaning liquid for rinsing or cleaning the conditioner head 46 and conditioner disk 50. The arm 42 can move the conditioner head 46 out of the cleaning cup and place the conditioner head 46 atop the polishing pad 30. In operation, the conditioner head 46 can be moved to the second cleaning station 160 (shown by path 136 in FIG. 3) after the polishing operation. The conditioner head 46 is then returned to the polishing pad 30 when a new substrate has been loaded and is ready for polishing.

The controller 90, and other control of other functional operations described in this specification, can be implemented in digital electronic circuitry, or in computer software, firmware, or hardware, or in combinations of them. The controller 90 and other functionality can be implemented using one or more non-transitory computer program products, i.e., one or more computer programs tangibly embodied in a machine readable storage device, for execution by, or to control the operation of, data processing apparatus, e.g., a programmable processor, a computer, or multiple processors or computers. The controller 90 and other functionality can be implemented using one or more programmable processors executing one or more computer programs, e.g., in a general purpose computer, or using special purpose logic circuitry, e.g., an FPGA (field programmable gate array) or an ASIC (application specific integrated circuit).

A number of embodiments of the invention have been described. Nevertheless, it will be understood that various modifications may be made. For example:

Rather than sweeping along an arcuate path, the conditioner head can be moved linearly, e.g., carried along a linear rail.

The polishing pad can be a belt driven by rollers rather a circular pad on a platen.

The polishing pad can be a fixed-abrasive pad or other material.

Accordingly, other embodiments are within the scope of the following claims

What is claimed is:

1. A polishing system, comprising:

a platen to hold a polishing pad;

a carrier head to hold a substrate against the polishing pad;

a conditioner including a conditioner head to hold a conditioner disk against the polishing pad;

a motor to move the conditioner head laterally movable relative to the platen;

a conditioning disk cleaning station positioned adjacent the platen to clean the conditioner disk; and a controller configured to cause the motor to during polishing of the substrate, move the conditioner head back and forth between a first position with the conditioner head over the polishing pad and a second position with the conditioner head in the conditioner disk cleaning station, and after polishing of the substrate, move the conditioner head to a third position, wherein the third position comprises a cleaning cup configured to contain a cleaning liquid for rinsing or cleaning the conditioner head.

2. The polishing system of claim 1, wherein the conditioning disk cleaning station includes a brush positioned to contact the conditioner disk when the conditioner head is in the conditioning disk cleaning station.

3. The polishing system of claim 2, wherein the brush is a disk having a planar face to contact the conditioner disk.

4. The polishing system of claim 2, wherein the brush is a cylinder having a cylindrical outer face to contact the conditioner disk.

5. The polishing system of claim 2, wherein the brush has a sponge-like surface.

6. The polishing system of claim 2, wherein the brush has bristles.

7. The polishing system of claim 2, wherein a top surface of the brush is coplanar with a polishing surface of the polishing pad.

8. The polishing system of claim 1, wherein the conditioning disk cleaning station includes one or more nozzles to direct a fluid onto the conditioner disk when the conditioner head is in the conditioning disk cleaning station.

9. The polishing system of claim 8, wherein the fluid comprises water.

10. The polishing system of claim 8, wherein the fluid comprises air or nitrogen.

11. The polishing system of claim 1, wherein the conditioner comprises an actuator configured to move the conditioner disk vertically.

12. The polishing system of claim 11, wherein the controller is configured to cause the actuator to maintain the conditioner disk at a consistent height as the conditioner head moves from the first position to the second position.

13. The polishing system of claim 1, wherein the controller is configured to cause the motor to, during polishing of the substrate, move the conditioner head to the second position in less than all sweeps of the conditioner head.

14. The polishing system of claim 13, wherein the controller is configured to cause the motor to, during polishing of the substrate, move the conditioner head to the second position periodically.

15. A method of chemical mechanical polishing, comprising:

bringing a substrate into contact with a polishing pad;

during polishing of the substrate, sweeping a conditioner disk between a first position in contact with the polishing pad and a second position in a conditioning disk cleaning station; and after polishing of the substrate, moving the conditioner disk to a third position in a cleaning cup.

16. The method of claim 15, comprising maintaining the conditioner disk at a consistent height as the conditioner disk moves from the first position to the second position.

17. The method of claim 15, comprising, during polishing of the substrate, moving the conditioner disk to the second position with each sweep of the conditioner disk.

18. The method of claim 15, comprising, during polishing of the substrate, moving the conditioner disk to the second position in less than all sweeps of the conditioner disk.

19. The method of claim 15, comprising scrubbing the conditioner disk with a brush in the conditioning disk cleaning station.

20. A polishing system, comprising:

a platen to hold a polishing pad;

a carrier head to hold a substrate against the polishing pad;

a conditioner including a conditioner head to hold a conditioner disk against the polishing pad;

a motor to move the conditioner head laterally movable relative to the platen;

a conditioning disk cleaning station positioned adjacent the platen to clean the conditioner disk; and a controller configured to cause the motor to, during polishing of the substrate, move the conditioner head back and forth between a first position with the conditioner head over the polishing pad and a second position with the conditioner head in the conditioner disk cleaning station with each sweep of the conditioner head.

* * * * *